US011110498B2

(12) United States Patent
Buslehner et al.

(10) Patent No.: US 11,110,498 B2
(45) Date of Patent: Sep. 7, 2021

(54) ADJUSTMENT DEVICE

(71) Applicant: Primetals Technologies Austria GmbH, Linz (AT)

(72) Inventors: Stefan Buslehner, Piberbach (AT); Gernot Dirisamer, Tollet (AT); Ansgar Radek, Steyregg (AT); Franz Schallauer, Bad Hall (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 320 days.

(21) Appl. No.: 15/764,690

(22) PCT Filed: Sep. 23, 2016

(86) PCT No.: PCT/EP2016/072717
§ 371 (c)(1),
(2) Date: Mar. 29, 2018

(87) PCT Pub. No.: WO2017/055189
PCT Pub. Date: Apr. 6, 2017

(65) Prior Publication Data

US 2018/0281038 A1 Oct. 4, 2018

(30) Foreign Application Priority Data

Oct. 2, 2015 (EP) ..... 15188048

(51) Int. Cl.
*B21B 31/32* (2006.01)
*B21B 38/00* (2006.01)
*B21B 38/10* (2006.01)

(52) U.S. Cl.
CPC ..... *B21B 31/32* (2013.01); *B21B 38/00* (2013.01); *B21B 38/10* (2013.01); *B21B 2271/02* (2013.01)

(58) Field of Classification Search
CPC ..... B21B 31/32; B21B 28/00; B21B 38/10; B21B 2271/02; B21B 31/16; B21B 31/20
(Continued)

(56) References Cited

U.S. PATENT DOCUMENTS 3,427,839 A * 2/1969 Neumann ..... B21B 37/62 72/13.3
3,596,490 A * 8/1971 Willeke ..... B21B 31/32 72/240
(Continued)

FOREIGN PATENT DOCUMENTS

CN 2282464 Y * 5/1998
DE 195 33 584 A1 3/1997
(Continued)

OTHER PUBLICATIONS

English translate (CN2282464Y), retrieved date Jan. 30, 2020.*
(Continued)

*Primary Examiner* — Adam J Eiseman
*Assistant Examiner* — Mohammed S. Alawadi
(74) *Attorney, Agent, or Firm* — Ostrolenk Faber LLP

(57) ABSTRACT

An adjustment device for adjusting a roll in a roll support (13) of a roll stand includes a cylinder housing (2) that can be secured to a roll support (13), and a piston (1) guided to move translationally in and across the roll support. The position of the piston (1) can be determined via a travel measurement device (9) connected to a coupling rod (6) secured directly to the piston (1). The piston (1) has a guide element (3) extending from the piston head (4) into a bore in the roll rack and in the direction toward the travel measurement device (9). The coupling rod (6) is secured to the guide element (3). To reduce the sensitivity of the adjustment device to a tipping, the guide element (3) is guided in a guide opening (14) of the cylinder housing (2).
(Continued)

A sliding guide (7) is provided for the coupling rod (6), which can be arranged on an end of a borehole (15) in the roll rack facing the travel measurement device (9).

9 Claims, 3 Drawing Sheets

(58) Field of Classification Search
USPC ..... 72/245, 248
See application file for complete search history.

(56) References Cited

U.S. PATENT DOCUMENTS 3,906,767 A * 9/1975 Tanaka ..... B21B 31/32 72/13.4
4,083,213 A * 4/1978 Vydrin ..... B21B 31/32 72/14.5
4,481,800 A * 11/1984 Ruhl ..... B21B 37/165 72/11.4
4,748,840 A * 6/1988 Schulze ..... B21B 31/32 72/245
5,029,400 A * 7/1991 Leclercq ..... B21B 31/32 33/657
5,666,203 A * 9/1997 Hansen ..... B21B 38/10 250/559.27
5,848,544 A * 12/1998 Brioschi ..... B21B 31/32 72/245
6,151,943 A 11/2000 Nihei et al. ..... 72/241.2
6,173,596 B1 * 1/2001 Lazzaro ..... B21B 38/10 72/10.1
7,047,783 B2 * 5/2006 Klein ..... B21B 31/24 475/5
7,188,496 B2 * 3/2007 Karam ..... B21B 38/008 72/10.1
7,426,844 B2 * 9/2008 Brandenfels ..... B21B 31/02 72/10.1
7,698,893 B2 * 4/2010 Langeder ..... B21B 37/62 60/534
2007/0289440 A1 * 12/2007 Langeder ..... F15B 15/2815 92/62
2008/0115551 A1 5/2008 Marc et al. ..... 72/226

FOREIGN PATENT DOCUMENTS

DE 10 2008 004 540 A1 7/2009
DE 102008004540 B4 * 12/2014 ..... B21B 37/62
EP 0 163 247 A2 12/1985
GB 1 275 424 5/1972
JP 2005-169482 A 6/2005
WO WO 2010/086514 A1 8/2010

OTHER PUBLICATIONS

English translate (DE102008004540A1), retrieved date Jan. 30, 2020.*
Machine Design, retrieved date Jan. 30, 2020.*
International Search Report dated Jan. 16, 2017 in corresponding PCT International Application No. PCT/EP2016/072717.
Written Opinion dated Jan. 16, 2017 in corresponding PCT International Application No. PCT/EP2016/072717.
European Search Report dated Dec. 9, 2015 in corresponding European Patent Application No. 15188048.1.

* cited by examiner

ADJUSTMENT DEVICE

CROSS-REFERENCE TO RELATED APPLICATIONS

The present application is a 35 U.S.C. §§ 371 national phase conversion of PCT/EP2016/072717, filed Sep. 23, 2016, which claims priority of European Patent Application No. 15188048.1, filed Oct. 2, 2015, the contents of which are incorporated by reference herein. The PCT International Application was published in the German language.

TECHNICAL FIELD

The invention relates to an adjustment device for adjusting a roll in a roll support of a roll stand, the adjustment device comprises a cylinder housing that is fastenable to a roll support, and a piston that is guided so as to be movable in translation in the cylinder housing. The position of the piston is able to be determined via a travel measurement device connected to a coupling rod, and to a system comprising a roll support and an adjustment device.

PRIOR ART

Each roll has a shaft at both ends. In roll stands comprising 4 or 6 rolls arranged vertically above each other, each roll shaft has its own chock. Such types of roll stands are well known as 4-Hi and 6-Hi roll stands and are shown, together with the corresponding actuating devices of the roll chocks, in US 2008/0115551 and in U.S. Pat. No. 6,151,943, for instance. Other types of roll stands comprise even more rolls, some of which are arranged laterally of the work rolls in a conveying direction of the rolled metal band in order to prevent excessive bending of the work rolls. Such roll stands are known as "20-Hi stands", "X-Hi stands" or "cassette-type" roll stands and are disclosed in WO 2010/086514 A1, for example. In those roll stands, usually only the topmost/bottommost backup rolls and optionally the intermediate rolls have chocks which are slidably arranged in the uprights of a roll stand, whereas the side rolls can be articulatedly mounted in some separate frame. The work rolls of such roll stands are usually arranged to be entirely "floating", being restricted in their movement only by the adjacent rolls and the rolled metal band. All those kinds of roll stands and arrangements of various types of rolls are known in the art.

Adjustment devices serve to subject an object to force and/or to move it into a particular position. For example, an adjustment device in a roll stand is used to push a roll in the direction of its counter roll in order to set the rolling gap which defines the thickness of the strip emerging from the roll stand through positioning the rolls with respect to one another. To apply the pressures necessary for this purpose, the adjustment device generally comprises a hydraulic cylinder with a cylinder housing and a piston guided in the cylinder housing, wherein the piston is held to be movable in translation along a longitudinal axis with respect to the cylinder housing by a pressure build-up in one of the pressure chambers arranged in the cylinder housing. In addition to adjustment movements, the adjustment device can also carry out return movements. For a person skilled in the art, the hydraulic cylinder is connected to a hydraulic system via pressure ports in order to function.

The hydraulic system regulates the pressure build-up and pressure breakdown in the pressure chambers via a control unit.

To control the adjustment movement and the return movement of the hydraulic cylinder precisely, particularly to set the rolling gap, a travel measurement device is in operative contact with the piston to determine the position of the piston relative to the cylinder housing.

A coupling rod is connected to the travel measurement device on one side and is joined to the piston by a spring element on the other side. The spring element or an entire spring arrangement is arranged within the cylinder housing. For maintenance purposes, it is accessible only upon complete disassembly of the hydraulic cylinder. Further drawbacks of the prior art include that the measurement precision decreases with increasing fatigue of the spring element; likewise, adjustment devices according to the prior art tend to be susceptible to tipping, causing measurement errors and false position data. Tipping causes the piston and cylinder housing to be misaligned so that in the event of tipping, the piston and cylinder housing no longer form a common longitudinal axis but are set at an angle to one another.

Other solutions in the prior art show coupling rods joined directly to the piston, for example the roll adjustment display in EP 0 163 247 A2 with a piston-cylinder unit and a corresponding measurement rod, or U.S. Pat. No. 5,029,400 A, or GB 1 275 424 A, in which the piston has a guide element which extends from the piston base in the direction of the travel measurement device and the coupling rod is fastened to the guide element.

OBJECT OF THE INVENTION

Therefore, it is an object of the invention to overcome the drawbacks of the prior art by using an adjustment device which allows alternative joining of the travel measurement device for determining the position of the piston and which adjustment device is not susceptible to signs of fatigue. Furthermore, the susceptibility of the adjustment device to tipping is intended to be reduced.

SUMMARY OF THE INVENTION

This object is achieved by an adjustment device for adjusting a roll in a roll support of a roll stand having the features disclosed herein.

The adjustment device herein is for adjusting a roll in a roll support of a roll stand. The adjustment device comprises a cylinder housing that is fastenable to a roll support, and a piston that is guided to be movable in translation in the cylinder housing, wherein the position of the piston in the cylinder housing is able to be determined via a travel measurement device connected to a coupling rod. The coupling rod is fastened directly to the piston. The piston has a guide element which extends in the cylinder housing from the piston base in the direction of the travel measurement device and the coupling rod is fastened to the guide element.

According to the invention, the guide element is guided in a guide opening of the cylinder housing so that a sliding guide for the coupling rod is provided is arrangeable at an end, facing the travel measurement device, of a bore in the roll support.

Because of the direct connection of the coupling rod and the piston, pretensioning of the coupling rod by a spring element is no longer necessary, since the coupling rod directly follows the movement of the piston. In this way, the measurement device is connected directly to the piston via the coupling rod so that elements that could potentially falsify the measurement results are no longer present between the piston and travel measurement device.

The guide element may be configured for example as a piston rod with a circular cross section. In this case, it serves as part of an additional piston guide which prevents tipping of the hydraulic cylinder and it generally extends in a direction normal to the piston base, or along the longitudinal axis of the hydraulic cylinder. Since the coupling rod is fastened on the opposite side of the guide element from the piston base, the coupling rod can be embodied in a correspondingly shorter manner. It is advantageous here for the guide element to be arranged in the center of the piston base and to be configured symmetrically with respect to the longitudinal axis. However, in alternative variant embodiments, it is also conceivable for the coupling rod to be fastened directly to the piston base, wherein the guide element, if one is provided, is embodied as a hollow cylinder and surrounds the coupling rod.

In order to guide the guide element easily and thus to allow the piston guide, the guide element is to be guided in a guide opening of the cylinder housing. Since the guide element projects at least partially out of the cylinder housing through the guide opening, the coupling rod is fastened to the guide element outside the pressure chamber of the hydraulic cylinder, whereby assembly or disassembly of the coupling rod and/or of the travel measurement device can take place without prior disassembly of the hydraulic cylinder.

In order to center the coupling rod in the bore and to prevent radial deflection of the coupling rod, a sliding guide for the coupling rod is provided, which is arrangeable at an end, facing the travel measurement device, of a bore in the roll support.

In a variant embodiment of the adjustment device, a sliding bush is arranged between the guide opening and guide element, the guide element is guided through the sliding bush. The sliding bush is preferably comprised of plastic material. The guiding of the guide element in the sliding bush, improves the piston guiding further, since friction effects are reduced and the sliding bush is able to be produced or additionally purchased cost-effectively with the necessary precision, compared with guiding taking place solely through the guide opening. Furthermore, the sliding bush also fulfills a sealing function to prevent the escape of hydraulic fluid from the cylinder housing.

According to a preferred variant embodiment of the invention, the coupling rod is connected to the guide element via a play-free threaded connection, generally comprised of a threaded bore and a threaded pin. It has proven to be particularly advantageous for the threaded bore to be formed in the top surface of the guide element and for the threaded pin to be formed by the coupling rod. The play-free nature of the threaded connection ensures that the coupling rod itself directly follows minor changes in the position of the piston without any micromovement in the thread in the direction of the longitudinal axis, which would falsify the measurement result of the travel measurement device.

In order to prevent release of the threaded connection, a twist prevention means, such as an axial retainer, can be provided, which prevents rotary movement of the coupling rod about the common longitudinal axis. The twist prevention means may be connected directly to the coupling rod or the twist prevention means may be connected to the guide element.

In a further preferred variant, embodiment the travel measurement device is fastenable on the opposite side of the roll support from the cylinder housing by means of a bracket in the operating state. Since the travel measurement device is spaced apart from the cylinder housing and is fastened on the other side of the roll support in the operating state, easy assembly and replaceability of the travel measurement device is provided, since that device is not located in the cylinder housing itself.

In a different field of application, the roll support may be any desired carrier element to which the adjustment device according to the invention is attached. In this case, the bracket serves in this case to hold the sensitive travel measurement device and is fastenable to the roll support, for example via fastening means such as screws.

Since adjustment devices are often used in adverse ambient conditions, for instance in rolling lines or in combined rolling pickling lines, in which the ambient air is contaminated with dirt particles, provision is made, in a further preferred variant embodiment, for the travel measurement device to be protected from the environment by a covering hood. For this purpose, the covering hood is formed either from plastics material, which has properties suitable for the application site, for instance high heat resistance, acid resistance or lye resistance, or from metal, for instance steel or stainless steel. The covering hood therefore protects the sensitive travel measurement device from contamination, in particular from the penetration of solid particles or liquids.

Furthermore, the covering hood also protects the travel measurement device from mechanical damage.

In order to particularly effectively prevent the penetration of very small dirt particles and in particular of liquids into the cavity accommodating the travel measurement device, in a further preferred variant embodiment of the invention, the bracket or the covering hood is connectable to a compressed air line via a port. This makes it possible to set an increased pressure, compared with the environment, in a cavity formed by the bracket and the covering hood. As a result of the formation of a positive pressure of between 0.1 bar and 3 bar, preferably between 0.25 bar and 1 bar, in particular of 0.5 bar, in the cavity, very small foreign bodies are prevented from penetrating into the cavity. Any openings in the bracket or in the covering hood have to be closed or sealed off in a corresponding manner in order to allow the formation of the positive pressure.

In a particularly preferred variant embodiment of the adjustment device, the travel measurement device is configured for position determining via a magnetostrictive measuring method. Magnetostrictive travel measurement devices are measuring elements that are known per se. They are distinguished by particularly high measurement accuracy and are largely insensitive to environmental influences, such as temperature, shaking, shock and vibrations. In this case, the magnetostrictive travel measurement device usually comprises a fixed base, an optical waveguide, a movable permanent magnet, and a transducer which converts a mechanical oscillation into an electrical signal. While magnetostrictive travel measurement is particularly advantageous, both optical, electrical and magnetoresistive measurement methods are conceivable for determining the position of the piston. In principle, the travel measurement devices comprise, according to the abovementioned measurement methods, two measuring elements which are movable relative to one another in order to determine the position of the piston relative to the cylinder housing via the relative movement of the measuring elements with respect to one another. As a rule, one of the measuring elements is connected to the coupling rod or is attached to the coupling rod in this case.

The object mentioned above is also achieved by a system having a roll support of a roll stand and an adjustment device according to the invention, wherein the cylinder housing is fastened to the roll support, the travel measurement device is arranged on the opposite side of the roll support from the cylinder housing, and the coupling rod connecting the piston and the travel measurement device is guided at least partially through a bore in the roll support, and a sliding guide for the coupling rod is arranged at the end, facing the travel measurement device, of the bore. As already mentioned, on account of its robust design, the adjustment device is particularly suitable for use in the roll support of a roll stand.

In this case, the adjustment device is generally attached to a cross member of the roll support, wherein the cylinder housing, with the piston guided therein, is fastened to that side of the roll support that faces the roll and the travel measurement device is arranged on that side of the roll support that faces away from the roll. To be able to receive the coupling rod which connects the piston and travel measurement device, the bore is formed in the roll support, wherein the bore advantageously extends coaxially with the longitudinal axis along which the piston and cylinder housing are oriented. As a result of the bore, easy installation of the adjustment device is also possible, since the coupling rod can also be introduced into the bore after the cylinder housing has been assembled, or the travel measurement device can be assembled independently of the cylinder housing. As a result of the reception of a portion of the coupling rod in the bore, it is also possible to reduce the overall height of the adjustment device, especially on the opposite side of the roll support from the roll.

In particular, it is advantageous here for the travel measurement device to not be fastened directly to the roll support but to be fastened to the roll support via the bracket, in order for it to be possible to fasten the travel measurement device easily, without complicated structural measures having to be performed on the roll support. The bracket also serves in this case to receive that end of the coupling rod that is connected to the travel measurement device. Therefore, a further variant embodiment provides for the travel measurement device to be fastened to the roll support via the bracket, for example via a screw connection.

In order to center the coupling rod in the bore and to prevent radial deflection of the coupling rod, a sliding guide for the coupling rod is arranged at that end of the bore that faces the travel measurement device. In this case, the sliding guide is preferably comprised of plastics material and allows the linear guiding of the coupling rod with little sliding friction between the surface of the coupling rod and the sliding guide, which is configured for example in an annular manner.

In a further preferred variant embodiment, the bore is configured as a recessed bore which sectionally has a greater diameter at the end facing the cylinder housing than at the opposite end, in order to be able to receive the guide element. In order to achieve good guiding by the guide element, the guide element has as large a diameter as possible, that diameter is limited, however, on account of the pressure to be built up in the pressure chamber. However, since the guide element projects out of the cylinder housing, it is necessary to create corresponding installation space by a portion of the bore having a correspondingly large diameter, such that the movement of the piston is not impeded by the guide element. By contrast, the coupling rod has a much smaller diameter, since the radial guide forces are already absorbed by the guide element. Thus, in order to keep the weakening of the roll support by the bore as small as possible, the diameter of the bore along the remaining length of the bore is smaller, but specifically large enough for the coupling rod to be able to be passed through.

The use of an adjustment device according to the invention in a roll stand is particularly advantageous. Since particularly accurate and reliable position data are required in order to set and regulate the rolling gap of a roll stand, the use of a robust travel measurement device according to the invention, which measures the position data of the hydraulic cylinder, improves the production quality, while reducing the regulating complexity. In particular as a result of the direct connection of the coupling rod and piston, particularly positive synergistic effects arise. Thus, as a result of the exact and unfalsified measurement of the position data of the adjustment device or of the piston relative to the roll support, connected to the cylinder housing, feed movement or return movement of the roll can be regulated precisely. Therefore, the invention also relates to the use of an adjustment device according to the invention in a roll support of a roll stand, wherein the positioning of the roll with regard to the roll support, in particular during a feed movement or a return movement of the roll, is regulated via position data measured continuously by the travel measurement device.

BRIEF DESCRIPTION OF THE DRAWINGS

In order to explain the invention further, reference is made in the following part of the description to the figures, from which further advantageous configurations, details and developments of the invention can be gathered. The figures should be understood as being by way of example and is intended to set out the character of the invention but not to limit it in any way, let alone describe it exhaustively. In the figures.

DESCRIPTION OF AN EMBODIMENT OF THE INVENTION

Figure 1:
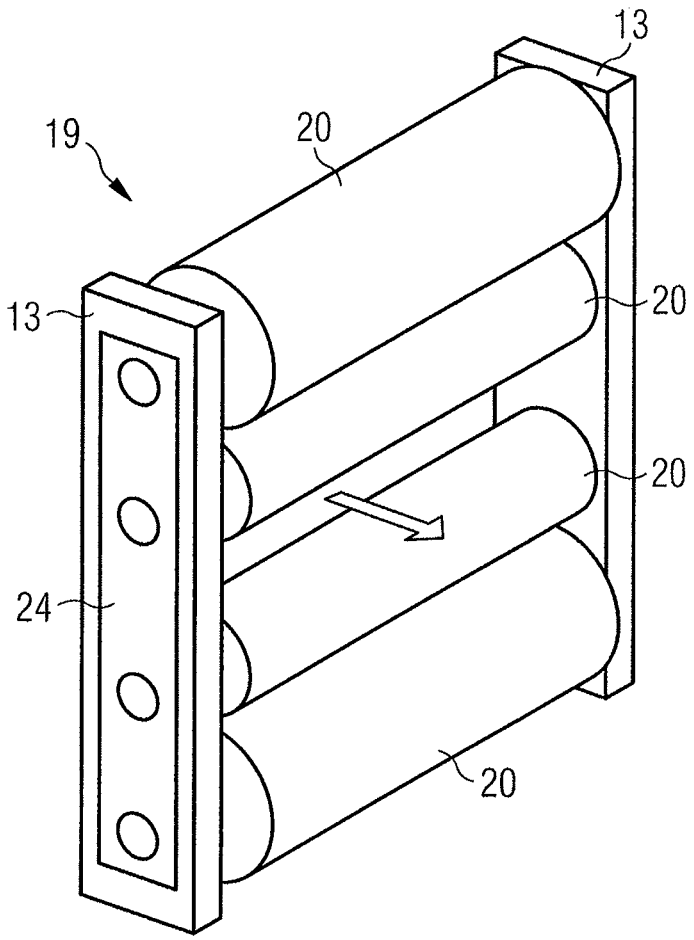
FIG. 1 shows a schematic view of a roll stand.

FIG. 1 shows a roll stand 19, which comprises two roll supports 13 and four rolls 20, from a perspective view. The four rolls 20 are arranged above each other in a vertical direction such that the rolled stock (not shown) is being rolled and conveyed in the roll gap between the two upper rolls and the two lower rolls of the roll stand 19 in a substantially horizontal direction, as indicated by an arrow. According to the specific purpose of the roll stand 19, the mounting of more than four rolls in a roll stand, is also possible. The shaft at each of the two ends of a roll 20 is mounted via a chock 22 (shown in FIG. 2) in the opening 24 of one of the two roll supports 13 and is as such movable in a vertical direction.

The end of each shaft of each roll in a roll stand does not necessarily have a respective chock. Referring to the exemplary roll stand depicted in FIG. 1 of the pending application (4-Hi stand), each roll has a chock at both of its ends, hence 4 chocks are arranged vertically above each other in a roll support 13 (with the roll stand comprising 8 chocks in total), of which only one chock is explicitly shown in FIG. 2. Moreover, each of the four chocks 22 in a roll support 13 are vertically movable in the respective opening 24 independently from the other chocks by some mechanism (usually hydraulic), for instance as indicated in FIGS. 3 and 4 of US 2008/0115551 A1 and in FIG. 1 of U.S. Pat. No. 6,151,943. According to the invention, there is only one measurement device per roll support for each of the uppermost and lowermost roll in the roll stand.

Figure 2:
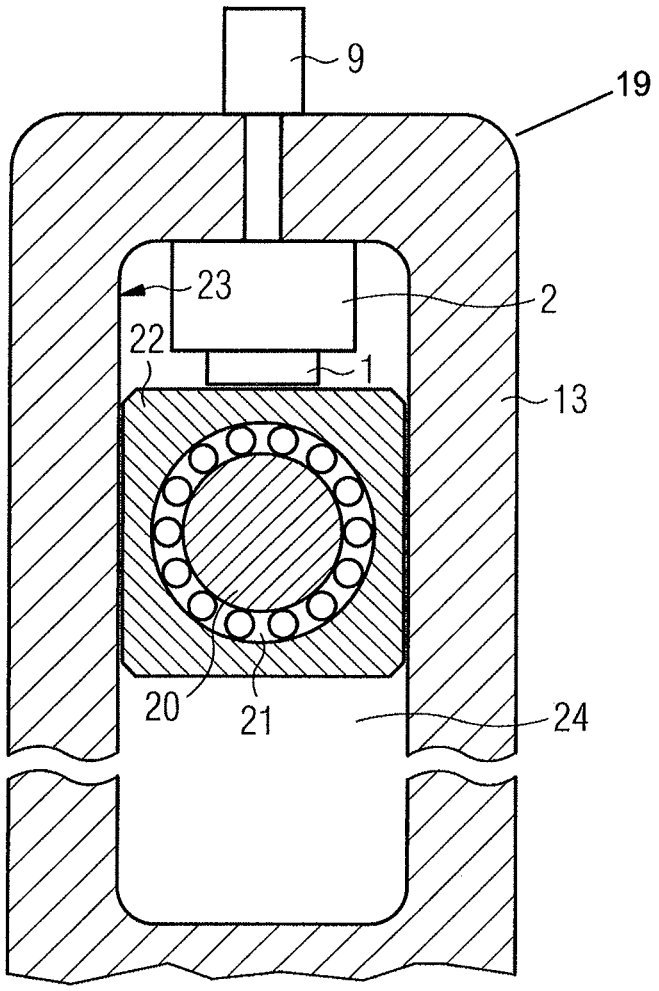
FIG. 2 shows a sectional illustration of a roll support.
Figure 3:
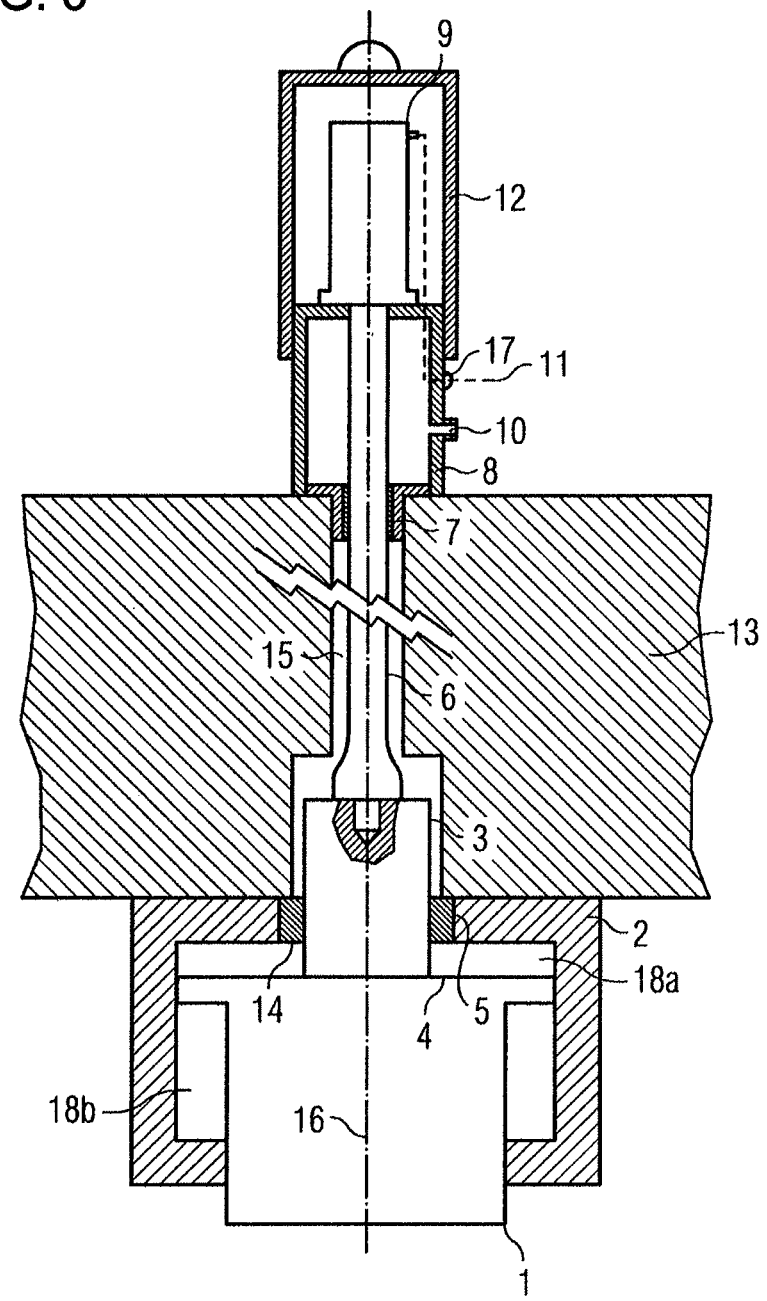
FIG. 3 shows a sectional illustration of an adjustment device according to the invention in the operating state.

FIG. 2 illustrates the mounting of a roll shaft in a roll support 13. The shaft at each end of a roll 20 is mounted via an axial bearing 21 in a chock 22, whereby the chock 22 can slide in a vertical direction along the inner faces 23 of an opening 24 in the roll support 13. The opening 24 can also receive the end sections of the other rolls comprised in the roll stand (not shown). The axial bearing 21 allows for rotation of the roll 20 around its axis, such that the roll 20 can be rotated either by a corresponding drive mounted to the shaft of the roll (not shown) or by the frictional forces being exerted on the surface of the roll by at least one of the adjacent rolls or by the rolled stock.

In the example in FIG. 2, the shaft of a roll 20 can be moved in a vertical direction within the opening 24 of the roll support 13 by a hydraulic cylinder 1, 2 being attached to the chock 22. As such, an adjustment device, of which the hydraulic cylinder 1, 2 is part, can forcibly act on the shaft of the roll 20 which translates into a rolling force being exerted onto the adjacent roll or directly onto the rolled stock. In order to control the size and the cross section of the roll gap of the roll stand 19 during the rolling process, the vertical position of the chock 22 of each roll 20 is monitored by a travel measurement device 9 that measures the vertical position of the piston 1 of the hydraulic cylinder. Because the piston 1 is rigidly fixed to the chock 22, the vertical position sensed by the measurement device 9 corresponds to a vertical position of the corresponding roll 20 such that the resulting roll gap can be calculated from the positions of the shafts of all rolls 20 of the roll stand 19.

Because the diameters of the rolls in a roll stand and their respective geometric positions are known, and all rolls are in touch with either the respective adjacent rolls and/or the rolled metal band, the roll gap can be deduced from the position measurement of said outermost rolls. Relative position measurements of adjacent bending blocks, which hold the chocks of the work rolls, as for instance shown in FIG. 3 of U.S. Pat. No. 7,174,758, are also conceivable but are subject to the elastic bending of the bending blocks when corresponding rolling and bending forces are applied thereto. In other words, measuring the position of the chocks of the uppermost and lowermost roll, which usually have the largest diameter of all rolls in a roll stand and hence the comparably largest stiffness along their rotational axis, results in the most reliable result for the roll gap during a rolling process.

FIG. 3 shows a preferred embodiment of the adjustment device according to the invention. The adjustment device comprises a cylinder housing 2 and a piston 1 guided in translation therein, which jointly form a hydraulic cylinder 1, 2. As a result of a change in pressure in one of the two pressure chambers 18*a*, 18*b* of the hydraulic cylinder 1, 2, the piston 1 moves parallel to a longitudinal axis 16 of the hydraulic cylinder 1, 2 and thus carries out an adjustment movement or a return movement. In alternative variants, only one pressure chamber 18*a*, 18*b* may be provided. The piston 1 is operatively connected to an object (not illustrated) to be adjusted, wherein pressure can be exerted by the piston 1 on the object to be adjusted, on the one hand, and an actual adjustment or return movement of the object to be adjusted can be brought about, on the other hand. In the exemplary embodiment shown, the adjustment device adjusts a roll in a roll support 13 of a roll stand. The object to be adjusted is thus the roll, not illustrated, of the roll stand.

The cylinder housing 2 is fastened to a carrier element via corresponding fastening means, such as screw connections or welded connections, wherein the carrier element is formed in the present exemplary embodiment by the roll support 13, to be more precise by a cross member of the roll support 13. In other applications, for example in the case of hydraulic presses, the carrier element is formed by a part corresponding to the cross member of the roll support 13. In this embodiment, the cylinder housing 2 is arranged on the underside of the roll support 13, wherein the underside faces the roll in the operating state of the roll stand.

The adjustment device further comprises a travel measurement device 9 by means of which the position of the piston 1 relative to the cylinder housing 2, or to the roll support 13, can be determined. The travel measurement device 9 is in this case arranged on the opposite side of the roll support 13 from the cylinder housing 2, i.e. in this case on the top side. To make the movement of the piston 1 measurable, the travel measurement device 9 is directly connected to the piston 1 via a coupling rod 6, such that the coupling rod 6 directly follows the movement of the piston 1 and passes on the position of the piston 1 to the travel measurement device 9, or the travel measurement device 9 measures the movement of the coupling rod 6.

On the side facing the roll support 13, or on the side facing the travel measurement device 9, i.e. the top side, the piston 1 has a piston base 4, to which, inter alia, pressure can be applied in order to achieve an adjustment movement. In the center of the piston base 4, the piston 1 has a guide element 3 which extends, parallel to the longitudinal axis 16, away from the piston base 4, in the direction of the travel measurement device, i.e. upward. The guide element 3 and the piston 1 can in this case be configured either in one piece, for example as a cast part or turned part, or in two or more pieces, such that the guide element 3 and piston 1 are manufactured separately, wherein the guide element 3 is fastened to the piston 1, for instance welded or screwed thereto, prior to the assembly of the adjustment device. In the variant embodiment illustrated, the guide element 3, just like the piston 1 and the bore of the cylinder housing 2, is configured as a cylinder and has a circular cross-sectional area with respect to the longitudinal axis 16. The diameter of the guide element 3 is in this case about 35% of the diameter of the piston 1, wherein values between 10% and 45%, in particular between 20% and 40%, are conceivable.

The guide element 3 is guided in a guide opening 14 in the cylinder housing 2 and projects upwardly through this guide opening 14 out of the cylinder housing 2. Since, as a result of the interaction of the guide element 3 and guide opening 14, the piston 1 is additionally guided and supported with respect to radially acting forces, tipping of the piston 1 relative to the cylinder housing 2 is prevented. Tipping can occur for example in the event of uneven loading by the object to be adjusted, in this case the roll, wherein the piston 1 and cylinder housing 2 no longer form a common longitudinal axis 16 in the event of tipping, but enclose an angle, between 0.5° and 10°, with one another. In order to further improve guiding, a sliding bush 5, in which the guide element 3 is guided in a sliding manner, is arranged in the guide opening 14. The sliding bush 5 is in this case advantageously manufactured from plastics material in order to reduce friction effects, and at the same time serves to seal off the first pressure chamber 18*a*, wherein it is also conceivable to attach additional sealing means, for instance sealing rings.

The guide element 3 additionally also serves for fastening the coupling rod 6, which is fastened to that side of the guide element 3 that faces away from the piston base 4, i.e. to the top side. In this case, a number of different fastening methods may be used, for example clamping connections, force-fitting or form-fitting connections. In the present exemplary embodiment, the coupling rod 6 is connected to the guide element 3 via a play-free threaded connection, wherein the coupling rod 6 has a threaded portion configured as a threaded pin and the guide element 3 has a corresponding threaded bore Other variants are conceivable, for example a variant in which the threaded portion is formed by the guide element 3 and the threaded bore by the coupling rod 6, or a variant in which fastening takes place via a number of play-free screws. Since the threaded connection does not have any axial play, i.e. no relative movement in the axial direction occurs between the coupling rod 6 and piston 1 in the event of a movement of the piston 1, the travel of the piston 1 is detectable by the travel measurement device 9 without measuring errors.

To make it possible to connect the travel measurement device 9 arranged on the top side of the roll support 13 and the piston 1, or guide element 3, located on the opposite side of the roll support 13 together via the coupling rod 6, the roll support 13 has a bore 15 in which the coupling rod 6 is partially guided. At the end facing the cylinder housing 2, i.e. the lower end, the diameter of the bore 15 is larger than at the opposite, upper, end, and so that part of the guide element 3 that projects out of the cylinder housing 2 can be received in that portion of the bore 15 that has the larger diameter. The axial extent of the portion is in this case at least great enough for the guide element 3 to be received entirely in the bore 15 in the upper end position of the piston 1. In the upper portion, the bore 15 has a smaller diameter such that the coupling rod 6 can pass through. In other words, the bore 15 is thus embodied as a recessed bore.

The travel measurement device 9 is joined to the roll support 13 via a bracket 8, wherein the bracket 8 receives that portion of the coupling rod 6 that projects out of the bore 15 and is thus arranged coaxially with the bore 15 and therefore also with the piston 1, guide element 3 and cylinder housing 2. The bracket 8 also forms a receptacle for the travel measurement device 9, wherein the travel measurement device 9 is likewise arranged concentrically with the longitudinal axis 16 and is in operative contact with the coupling rod 6, or is connected directly to the coupling rod 6. In the present exemplary embodiment, only one housing of the travel measurement device 9 is illustrated. The housing is not in section, such that measuring elements which are arranged in the interior of the housing and are movable relative to one another cannot be seen. The housing of the travel measurement device 9 is in this case fastened, preferably screwed, to the bracket 8. The coupling rod 6 projects in this case into the housing of the travel measurement device 9 and is connected to one of the measuring elements. The position of the piston 1 is in this case determined via the detection of the relative movement of the two measuring elements. It is also conceivable in this case for the coupling rod 6 not to project into the housing of the travel measurement device 9 but for the measuring element joined to the coupling rod 6 to interact with the measuring element arranged in the housing of the travel measurement device 9.

The travel measurement device 9 can in this case be configured to determine a position of the piston 1, or of the coupling rod 6, by means of a magnetostrictive measuring method which works on the basis of a physical principle known per se. In this case, a permanent magnet of the travel measurement device 9 is generally connected to the coupling rod, while at least one fixed base of the travel measurement device 9 is arranged in the housing of the travel measurement device 9. The magnetostrictive measuring method is suitable in particular on account of its insensitivity to environmental influences, such as temperature or shaking, and the high precision of the measured values. In alternative variant embodiments of the invention, however, it is also possible for other measuring methods, for example magnetoresistive, optical or electronic measuring methods, to be used, without departing from the scope of the invention.

The position, detected by the travel measurement device 9, of the piston 1 is passed on to a control unit, not illustrated, of the adjustment device, or of the roll stand, via a connecting line 11. In this control unit, the adjustment movement of the piston 1 is regulated in a corresponding manner, in order in particular to exactly set the rolling gap.

In order to fix and to guide the coupling rod 6 in the radial direction, a sliding guide 7, which is preferably likewise manufactured from plastics material, is attached to the upper end of the bore 15. The sliding guide 7 has, in the present exemplary embodiment, a collar that extends in the radial direction, in order to be supported on the roll support 13.

In order to protect the sensitive electronics of the travel measurement device 9, a covering hood 12 is fastened to the bracket 8, which protects the travel measurement device 9 from the environment and prevents penetration of foreign bodies, for instance dirt particles or liquids. The bracket 8 and covering hood 12 in this case form a cavity in which the travel measurement device 9 and the upper end of the coupling rod 6 are arranged. For even further protection, the cavity formed, which is sealed off from the environment, is able to be connected to a compressed air line via a port 10 in order to form a positive pressure in the cavity by feeding compressed air, such that, even in the case of minor leaks, no foreign bodies can penetrate into the cavity. The positive pressure compared with atmospheric pressure is in this case generally between 0.5 bar and 1 bar. In order for it to be possible to guide the connecting line 11 out of the cavity, a cable feedthrough 17 is provided in the bracket 8, said cable feedthrough 17 being sealed off for example via a PG screw connection. The port 10 and the cable feedthrough 17 can be attached both to the bracket 8 and to the covering hood 12.

LIST OF REFERENCE SIGNS

1 Piston
2 Cylinder housing
3 Guide element
4 Piston base
5 Sliding bush
6 Coupling rod
7 Sliding guide
8 Bracket
9 Travel measurement device
10 Port
11 Connecting line
12 Covering hood
13 Roll support
14 Guide opening
15 Bore
16 Longitudinal axis
17 Cable feedthrough
**18*a*** First pressure chamber
**18*b*** Second pressure chamber

The invention claimed is:

1. A system for adjusting a roll in a roll support, the system comprising:

an adjustment device for adjusting the roll in the roll support, the adjustment device comprising:

a cylinder housing fastened to the roll support and a piston in the cylinder housing, guided in the cylinder housing so as to be movable in translation in the cylinder housing;

a coupling rod fastened to the piston;

a travel measurement device connected to the coupling rod for and configured for determining a position of the piston;

the piston including a piston base thereon located along the piston, a guide element of the piston and which extends from the piston base in the direction of the travel measurement device, and the coupling rod is fastened to the guide element;

the travel measurement device is arranged on an opposite side of the roll support from the cylinder housing; a guide opening in the cylinder housing, the guide element is guided in the guide opening of the cylinder housing;

a bore in and extending through the roll support;

a sliding guide for slidably guiding the coupling rod through the bore in the roll support, the sliding guide is arranged within an end of the bore in the roll support facing the travel measurement device, wherein the coupling rod connects the piston and the travel measurement device and is guided at least partially through the bore in the roll support, wherein the bore is configured as a recessed bore comprised of a greater diameter at the end facing the cylinder housing than at the opposite end, wherein the guide element is a piston rod with a circular cross section, and wherein the guide element extends through the cylinder housing and into the end of the bore having the greater diameter.

2. The system as claimed in claim 1, further comprising a sliding bush arranged between the guide opening and the guide element, wherein the guide element is guided through the sliding bush.

3. The system as claimed in claim 1, further comprising a play-free threaded connection connecting the coupling rod to the guide element.

4. The system as claimed in claim 1, further comprising a bracket fastening the travel measurement device fastened on the opposite side of the roll support from the cylinder housing.

5. The system as claimed in claim 1, further comprising a covering hood configured and located for protecting the travel measurement device from the environment.

6. The system as claimed in claim 5, further comprising the bracket or the covering hood is connectable to a compressed air line which is configured to set an increased pressure, compared with the environment, in a cavity formed by the covering hood on the bracket.

7. The system as claimed in claim 1, further comprising the travel measurement device is configured for position determining via a magnetostrictive measuring method.

8. The system as claimed in claim 1, further comprising the travel measurement device is fastened to the roll support via the bracket.

9. A method for regulating positioning of the roll with respect to the roll support for the roll using the system of claim 1, the method comprising: positioning the roll with respect to the roll support during a feed movement or a return movement of the roll, and regulating the movements via position data measured continuously by the travel measurement device.

* * * * *